US011459629B2

(12) United States Patent
Hayakawa et al.

(10) Patent No.: US 11,459,629 B2
(45) Date of Patent: Oct. 4, 2022

(54) METHOD OF PRODUCING GRAIN-ORIENTED ELECTRICAL STEEL SHEET

(71) Applicant: JFE STEEL CORPORATION, Tokyo (JP)

(72) Inventors: Yasuyuki Hayakawa, Tokyo (JP); Yuiko Ehashi, Tokyo (JP); Masanori Takenaka, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 131 days.

(21) Appl. No.: 16/076,403

(22) PCT Filed: Feb. 16, 2017

(86) PCT No.: PCT/JP2017/005714

§ 371 (c)(1),
(2) Date: Aug. 8, 2018

(87) PCT Pub. No.: WO2017/145907

PCT Pub. Date: Aug. 31, 2017

(65) Prior Publication Data

US 2019/0085423 A1 Mar. 21, 2019

(30) Foreign Application Priority Data

Feb. 22, 2016 (JP) ..... JP2016-031368

(51) Int. Cl.
*C21D 8/12* (2006.01)
*C22C 38/60* (2006.01)
(Continued)

(52) U.S. Cl.
CPC ..... *C21D 8/12* (2013.01); *C21D 1/28* (2013.01); *C21D 8/0226* (2013.01);
(Continued)

(58) Field of Classification Search
CPC ..... C21D 8/12; C22C 38/60
(Continued)

(56) References Cited

U.S. PATENT DOCUMENTS 4,468,551 A 8/1984 Neiheisel
4,797,167 A * 1/1989 Nakayama ..... C21D 8/1261 148/111

(Continued)

FOREIGN PATENT DOCUMENTS

EP 0253904 A1 1/1988
EP 2910658 A1 8/2015

(Continued)

OTHER PUBLICATIONS

May 16, 2017, International Search Report issued in the International Patent Application No. PCT/JP2017/005714.

(Continued)

*Primary Examiner* — Weiping Zhu
(74) *Attorney, Agent, or Firm* — Kenja IP Law PC

(57) ABSTRACT

To improve and stabilize magnetic properties, a steel sheet is soaked in a temperature range of 1000° C. or more and 1120° C. or less for 200 sec or less and then soaked in a temperature range of 650° C. or more and 1000° C. or less for 200 sec or less in annealing before final cold rolling, and the amount of Al in precipitates after the annealing before the final cold rolling is limited to 50% or more of the total amount of Al contained in the steel slab.

7 Claims, 4 Drawing Sheets

(51) Int. Cl.

| | |
|---|---|
| ***H01F 1/147*** | (2006.01) |
| ***C22C 38/00*** | (2006.01) |
| ***C22C 38/12*** | (2006.01) |
| ***C22C 38/06*** | (2006.01) |
| ***C21D 1/28*** | (2006.01) |
| ***C22C 38/08*** | (2006.01) |
| ***H01F 1/16*** | (2006.01) |
| ***C22C 38/14*** | (2006.01) |
| ***C22C 38/34*** | (2006.01) |
| ***C22C 38/16*** | (2006.01) |
| ***C22C 38/02*** | (2006.01) |
| ***C21D 9/46*** | (2006.01) |
| ***C22C 38/04*** | (2006.01) |
| ***C21D 8/02*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/54*** | (2006.01) |

(52) U.S. Cl.
CPC ..... *C21D 8/0236* (2013.01); *C21D 8/0273* (2013.01); *C21D 8/1205* (2013.01); *C21D 8/1261* (2013.01); *C21D 8/1266* (2013.01); *C21D 8/1272* (2013.01); *C21D 8/1283* (2013.01); *C21D 9/46* (2013.01); *C22C 38/001* (2013.01); *C22C 38/008* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C22C 38/16* (2013.01); *C22C 38/34* (2013.01); *C22C 38/42* (2013.01); *C22C 38/44* (2013.01); *C22C 38/46* (2013.01); *C22C 38/48* (2013.01); *C22C 38/54* (2013.01); *C22C 38/60* (2013.01); *H01F 1/147* (2013.01); *H01F 1/14783* (2013.01); *H01F 1/16* (2013.01); *C21D 2201/05* (2013.01)

(58) Field of Classification Search
USPC ..... 148/111
See application file for complete search history.

(56) References Cited

U.S. PATENT DOCUMENTS

| | | | | |
|---|---|---|---|---|
| 4,919,733 | A | 4/1990 | Salsgiver et al. | |
| 4,979,997 | A | 12/1990 | Kobayashi et al. | |
| 9,187,798 | B2 * | 11/2015 | Takenaka | C21D 8/12 |
| 9,708,682 | B2 * | 7/2017 | Hayakawa | C23C 8/26 |
| 9,761,360 | B2 * | 9/2017 | Takenaka | C22C 38/60 |
| 2009/0165895 | A1 | 7/2009 | Ushigami et al. | |
| 2012/0312424 | A1 | 12/2012 | Murakami et al. | |

FOREIGN PATENT DOCUMENTS

| | | | | |
|---|---|---|---|---|
| JP | 2782086 | B2 | | 7/1998 |
| JP | H11117022 | A | | 4/1999 |
| JP | 2000129356 | A | | 5/2000 |
| JP | 2005126742 | A | | 5/2005 |
| JP | 2006299297 | A | | 11/2006 |
| JP | 2007138199 | A | | 6/2007 |
| JP | 2015200002 | A | * | 11/2015 |
| JP | 2016000856 | A | | 1/2016 |
| WO | 9848062 | A1 | | 10/1998 |

OTHER PUBLICATIONS

Y. Ushigami et al., Precipitation Behaviors of Injected Nitride Inhibitors during Secondary Recrystallization Annealing in Grain Oriented Silicon Steel, Materials Science Forum, 1996, pp. 593-598, vols. 204-206.

Dec. 4, 2018, the Extended European Search Report issued by the European Patent Office in the corresponding European Patent Application No. 17756346.7.

Oct. 16, 2018, Notification of Reasons for Refusal issued by the Japan Patent Office in the corresponding Japanese Patent Application No. 2018-501623 with English language concise statement of relevance.

T. Ros-Yañez et al., Production of high silicon steel for electrical applications by thermomechanical processing, Journal of Materials Processing Technology, 2003, pp. 132-137, vol. 141.

* cited by examiner

METHOD OF PRODUCING GRAIN-ORIENTED ELECTRICAL STEEL SHEET

TECHNICAL FIELD

The present disclosure relates to a method of producing a grain-oriented electrical steel sheet, and particularly relates to a method of producing a grain-oriented electrical steel sheet that suppresses magnetic property variations in a coil without performing high-temperature slab heating.

BACKGROUND

A grain-oriented electrical steel sheet is a soft magnetic material used as an iron core material of a transformer or a generator, and has crystal texture in which the <001> orientation which is the easy magnetization axis of iron is highly aligned with the rolling direction of the steel sheet. Such texture is formed through secondary recrystallization of preferentially causing the growth of giant crystal grains in the (110)[001] orientation which is called Goss orientation, when secondary recrystallization annealing is performed in a process of producing the grain-oriented electrical steel sheet.

The grain-oriented electrical steel sheet is conventionally produced by a process of containing a precipitate (inhibitor component) such as MnS, MnSe, and AlN in the slab stage, heating the slab at a high temperature exceeding 1300° C. to dissolve the inhibitor component, and causing fine precipitation in a subsequent step to develop secondary recrystallization.

Thus, high-temperature slab heating exceeding 1300° C. is necessary in the conventional grain-oriented electrical steel sheet production process, which requires very high production cost. The conventional process therefore has a problem of being unable to meet the recent demands to reduce production costs.

To solve this problem, for example, JP 2782086 B2 (PTL 1) proposes a method of containing acid-soluble Al (sol.Al) in an amount of 0.010% to 0.060% and, while limiting slab heating to low temperature, performing nitriding in an appropriate nitriding atmosphere in a decarburization annealing step so that (Al, Si)N is precipitated and used as an inhibitor in secondary recrystallization.

According to PTL 1, (Al, Si)N disperses finely in the steel, and functions as an effective inhibitor. In the steel sheet after subjection to the nitriding treatment, a precipitate ($Si_3N_4$ or (Si, Mn)N) mainly containing silicon nitride is formed only in the surface layer. In the subsequent secondary recrystallization annealing, the precipitate mainly containing silicon nitride changes to Al-containing nitride ((Al, Si)N or AlN) which is thermodynamically more stable. Here, according to Y. Ushigami et al. "Precipitation Behaviors of Injected Nitride Inhibitors during Secondary Recrystallization Annealing in Grain Oriented Silicon Steel" Materials Science Forum Vols. 204-206 (1996) pp. 593-598 (NPL 1), $Si_3N_4$ present in the vicinity of the surface layer dissolves during heating in the secondary recrystallization annealing, whereas nitrogen diffuses into the steel and, when the temperature exceeds 900° C., precipitates as Al-containing nitride approximately uniform in the sheet thickness direction, with it being possible to obtain grain growth inhibiting capability (inhibition effect) throughout the sheet thickness. This technique has an advantage that the same amount and grain size of precipitate can be obtained in the sheet thickness direction relatively easily, as compared with the precipitate dispersion control using high-temperature slab heating.

Meanwhile, a technique of developing secondary recrystallization without containing any inhibitor component in the slab is also under study. For example, JP 2000-129356 A (PTL 2) describes a technique (inhibitorless method) that enables secondary recrystallization without containing any inhibitor component.

The inhibitorless method develops secondary recrystallization by texture (texture control) using more highly purified steel. The inhibitorless method does not require high-temperature slab heating and enables production without a special step such as nitriding, and so can produce a grain-oriented electrical steel sheet at lower cost.

CITATION LIST

Patent Literatures

PTL 1: JP 2782086 B2
PTL 2: JP 2000-129356 A

Non-Patent Literature

NPL 1: Y. Ushigami et al. "Precipitation Behaviors of Injected Nitride Inhibitors during Secondary Recrystallization Annealing in Grain Oriented Silicon Steel" Materials Science Forum Vols. 204-206 (1996) pp. 593-598

SUMMARY

Technical Problem

However, the inhibitorless method has a problem in that the magnetic properties of the steel sheet vary significantly due to variations in the amounts of trace impurities such as S and N and variations in the conditions such as hot rolling temperature, hot band annealing temperature, and primary recrystallization annealing temperature. Such variations in magnetic properties are mainly caused by an inhibitor component remaining in minute amount. It is, however, virtually impossible to completely remove such a minute amount of inhibitor component, because of technological and economic difficulties. Besides, while such a minute amount of inhibitor component precipitates during hot rolling, temperature variations in the transverse direction and the longitudinal direction inevitably occur during coil rolling, so that magnetic property scattering in the coil is inevitable.

It could therefore be helpful to provide a method of producing a grain-oriented electrical steel sheet that does not require high-temperature slab heating, achieves low cost and high productivity, and suppresses iron loss variations of the steel sheet.

Solution to Problem

We conducted intensive studies to solve the problems stated above.

As a result, we newly discovered that the magnetic properties can be stably improved even with slab heating in a low temperature range of 1300° C. or less, by setting the total content of S and/or Se in steel slab components to more than 0.0015% and 0.010% or less, and performing soaking in a temperature range of 1000° C. or more and 1120° C. or less (soaking temperature in the first stage) for 200 sec or less and then performing soaking in a temperature range of 650° C. or more and 1000° C. or less (soaking temperature in the second stage) for 200 sec or less in annealing before final cold rolling, to limit the amount of Al in precipitates after the annealing before the final cold rolling to 50% or more of the total amount of Al (total Al amount) contained in the steel slab.

The following describes the experimental results that led to the present disclosure.

Experiment

A slab of steel A having a composition containing C: 0.03 mass %, Si: 3.2 mass %, Mn: 0.08 mass %, P: 0.05 mass %, Cu: 0.10 mass %, Sb: 0.03 mass %, sol.Al: 60 mass ppm, N: 40 mass ppm, S: 5 mass ppm, Se: 1 mass ppm, and the balance being Fe and inevitable impurities and a slab of steel B having a composition containing C: 0.03 mass %, Si: 3.2 mass %, Mn: 0.08 mass %, P: 0.05 mass %, Cu: 0.10 mass %, Sb: 0.03 mass %, sol.Al: 60 mass ppm, N: 40 mass ppm, S: 75 mass ppm, Se: 1 mass ppm, and the balance being Fe and inevitable impurities were each heated to 1220° C., and then hot rolled to obtain a hot rolled sheet with a sheet thickness of 2.5 mm. The hot rolled sheet was then subjected to hot band annealing in a pattern illustrated in FIG. 1. After the hot band annealing, precipitates were extracted, and the amount of Al in the precipitates was analyzed. The analysis of the amount of precipitated Al was conducted by the method disclosed in Chino, et al. "Tetsu to hagane" (Iron and steel), the Iron and Steel Institute of Japan, December 1988, vol. 74, pp. 2041-2046. After the hot band annealing, the steel sheet was cold rolled to 0.22 mm.

After the cold rolling, primary recrystallization annealing also serving as decarburization of performing soaking at 850° C. for 120 sec was performed in an atmosphere of a hydrogen partial pressure of 55%, a nitrogen partial pressure of 45%, and a dew point of 55° C. Subsequently, an annealing separator having MgO as a main ingredient was applied to the primary recrystallized sheet by 15 g/m$^2$ per both sides, and dried. The primary recrystallized sheet was then subjected to secondary recrystallization annealing under the conditions of heating to 800° C. at a heating rate of 15° C./h in a nitrogen atmosphere, heating from 800° C. to 870° C. at a heating rate of 5° C./h, retaining at 870° C. for 50 hr, and then switching to a hydrogen atmosphere and retaining at 1180° C. for 10 hr. After final annealing, an agent containing 50% of colloidal silica and magnesium phosphate was applied and dried, and flattening annealing was performed at 850° C. for 20 sec in a mixed atmosphere of nitrogen and hydrogen, to adjust the shape. FIG. 2 illustrates a graph of the relationship between the soaking temperature in the second stage of the hot band annealing (T ° C. in FIG. 1) and the magnetic flux density after the flattening annealing ($B_8$), for the steel A and the steel B. As illustrated in FIG. 2, in the steel B with a total content of S and Se of 76 ppm, high magnetic flux density was obtained when the soaking temperature in the second stage was in a range of 650° C. to 1000° C. and especially in a range of 700° C. to 900° C., as compared with the steel A with a total content of S and Se of 6 ppm.

FIG. 3 illustrates the soaking temperature in the second stage of the hot band annealing and the proportion of the amount of Al in precipitates to the total amount of Al, for the steel B. The total amount of Al denotes the total amount of Al contained in the steel slab. As illustrated in FIG. 3, the amount of precipitated Al increased when the soaking temperature in the second stage was in a range of 650° C. to 1000° C. In particular, approximately the total amount of Al precipitated in a range of 700° C. to 900° C. FIG. 4 illustrates the relationship between the proportion of the amount of Al in precipitates to the total amount of Al and the magnetic flux density after the flattening annealing. When the amount of Al in precipitates was higher, the magnetic flux density was higher. In the case where the amount of precipitated Al was 50% or more and especially 90% or more of the total amount of Al, favorable magnetic flux density was obtained.

The reasons why, when using raw material with the total content of S and Se increased to 76 ppm as in the steel B and performing annealing before final cold rolling in a two-stage soaking pattern, the amount of precipitated Al increased with the soaking temperature in the second stage being in a range of 650° C. to 1000° C. and the magnetic flux density was improved are not exactly clear, but we consider the reasons as follows. By causing Al as an impurity to precipitate by soaking treatment in the second stage, the grain growth inhibiting capability is kept constant, thus stabilizing the development of secondary recrystallization. Moreover, by adding S, not only a precipitate such as MnS or $Cu_2S$ is formed, but also the grain boundary segregation effect by solute S content is achieved. During soaking treatment in the second stage, the grain boundary segregation effect by solute S increases, as a result of which the magnetic flux density is improved. In the case where the S content is low, although the development of secondary recrystallization is stabilized by an increase in the amount of precipitated Al during soaking in the second stage, the grain boundary segregation effect by solute S content is not achieved, which results in insufficient improvement in magnetic flux density. In other words, by subjecting raw material to which a minute amount of S has been added to annealing before final cold rolling in a two-stage soaking pattern, the grain growth inhibiting capability is kept constant, and the grain boundary segregation effect by S is maximized. This improves the magnetic flux density. As with S, Se also forms a precipitate such as MnSe or $Cu_2Se$ and exhibits a grain boundary segregation effect as solute Se, thus improving the magnetic flux density.

The present disclosure provides a method that can be referred to as subtle inhibition control (SIC) method. The SIC method is better than the conventional inhibitor technique or inhibitorless technique, as it can simultaneously realize low-temperature slab heating and iron loss variation suppression in the coil.

The present disclosure is based on these discoveries and further studies. We thus provide the following.

1. A method of producing a grain-oriented electrical steel sheet, comprising: heating a steel slab at 1300° C. or less, the steel slab having a chemical composition containing (consisting of), in mass %, C: 0.002% or more and 0.08% or less, Si: 2.0% or more and 8.0% or less, Mn: 0.02% or more and 1.00% or less, S and/or Se: more than 0.0015% and 0.010% or less in total, N: less than 60 mass ppm, acid-soluble Al: less than 100 mass ppm, and a balance being Fe and inevitable impurities; subjecting the steel slab to hot rolling, to obtain a hot rolled steel sheet; optionally subjecting the hot rolled steel sheet to hot band annealing; subjecting the hot rolled steel sheet to cold rolling once, or twice or more with intermediate annealing performed therebetween, to obtain a cold rolled steel sheet; subjecting the cold rolled steel sheet to primary recrystallization annealing; applying an annealing separator to a surface of the cold rolled steel sheet after the primary recrystallization annealing; and then subjecting the cold rolled steel sheet to secondary recrystallization annealing, wherein in the case of not performing the intermediate annealing, in the hot band annealing, the hot rolled steel sheet is soaked in a temperature range of 1000° C. or more and 1120° C. or less for 200 sec or less and then soaked in a temperature range of 650° C. or more and 1000° C. or less for 200 sec or less, and in the case of performing the intermediate annealing, in final intermediate annealing, the hot rolled steel sheet is soaked in a temperature range of 1000° C. or more and 1120° C. or less for 200 sec or less and then soaked in a temperature range of 650° C. or more and 1000° C. or less for 200 sec or less, and in the case of not performing the intermediate annealing, an amount of Al in precipitates after the hot band annealing is limited to 50% or more of a total amount of Al contained in the steel slab, and in the case of performing the intermediate annealing, an amount of Al in precipitates after the final intermediate annealing is limited to 50% or more of the total amount of Al contained in the steel slab.

2. The method of producing a grain-oriented electrical steel sheet according to 1., wherein the chemical composition further contains, in mass %, one or more selected from Sn: 0.001% or more and 0.20% or less, Sb: 0.001% or more and 0.20% or less, Ni: 0.001% or more and 1.50% or less, Cu: 0.001% or more and 1.50% or less, Cr: 0.001% or more and 0.50% or less, P: 0.001% or more and 0.50% or less, Mo: 0.001% or more and 0.50% or less, Ti: 0.001% or more and 0.10% or less, Nb: 0.001% or more and 0.10% or less, V: 0.001% or more and 0.10% or less, B: 0.0002% or more and 0.0025% or less, Bi: 0.001% or more and 0.10% or less, Te: 0.001% or more and 0.10% or less, and Ta: 0.001% or more and 0.10% or less.

3. The method of producing a grain-oriented electrical steel sheet according to 1. or 2., comprising subjecting the cold rolled steel sheet to nitriding treatment.

4. The method of producing a grain-oriented electrical steel sheet according to 1. or 2., wherein one or more selected from sulfide, sulfate, selenide, and selenate are added to the annealing separator.

Advantageous Effect

With the use of the subtle inhibition control (SIC) method that combines a minute amount of precipitate and a grain boundary segregation element, the disclosed technique does not require high-temperature slab heating, achieves low cost and high productivity, and suppresses iron loss variations of the steel sheet.

DETAILED DESCRIPTION

Figure 1:
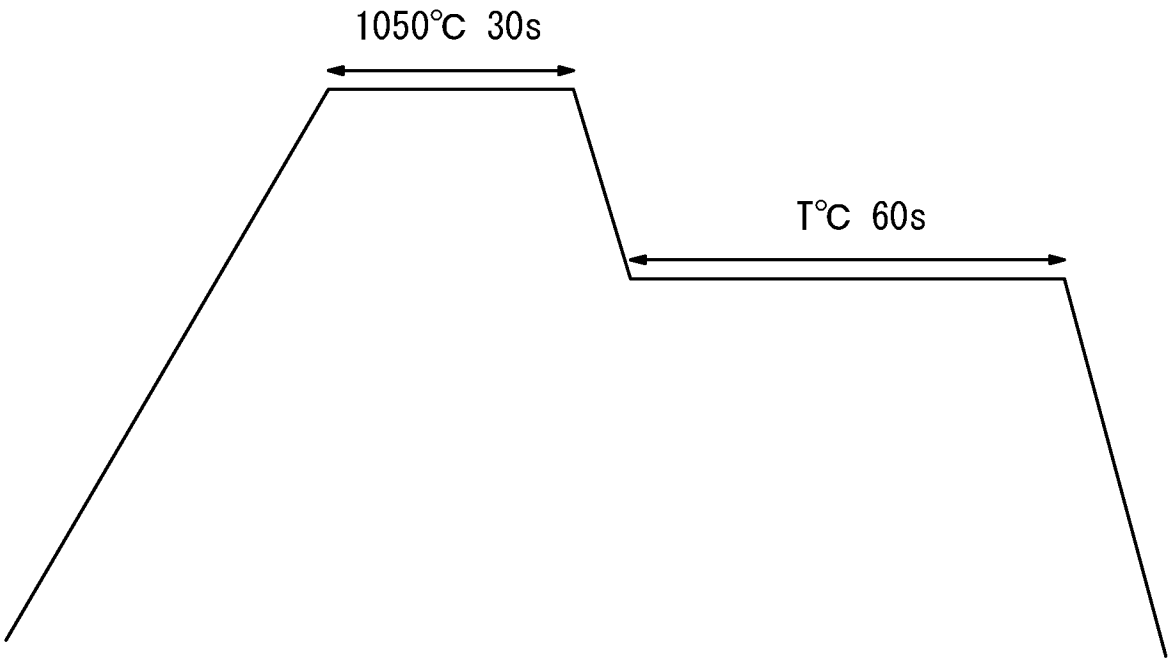
FIG. 1 is a graph illustrating a pattern of annealing before final cold rolling.
Figure 2:
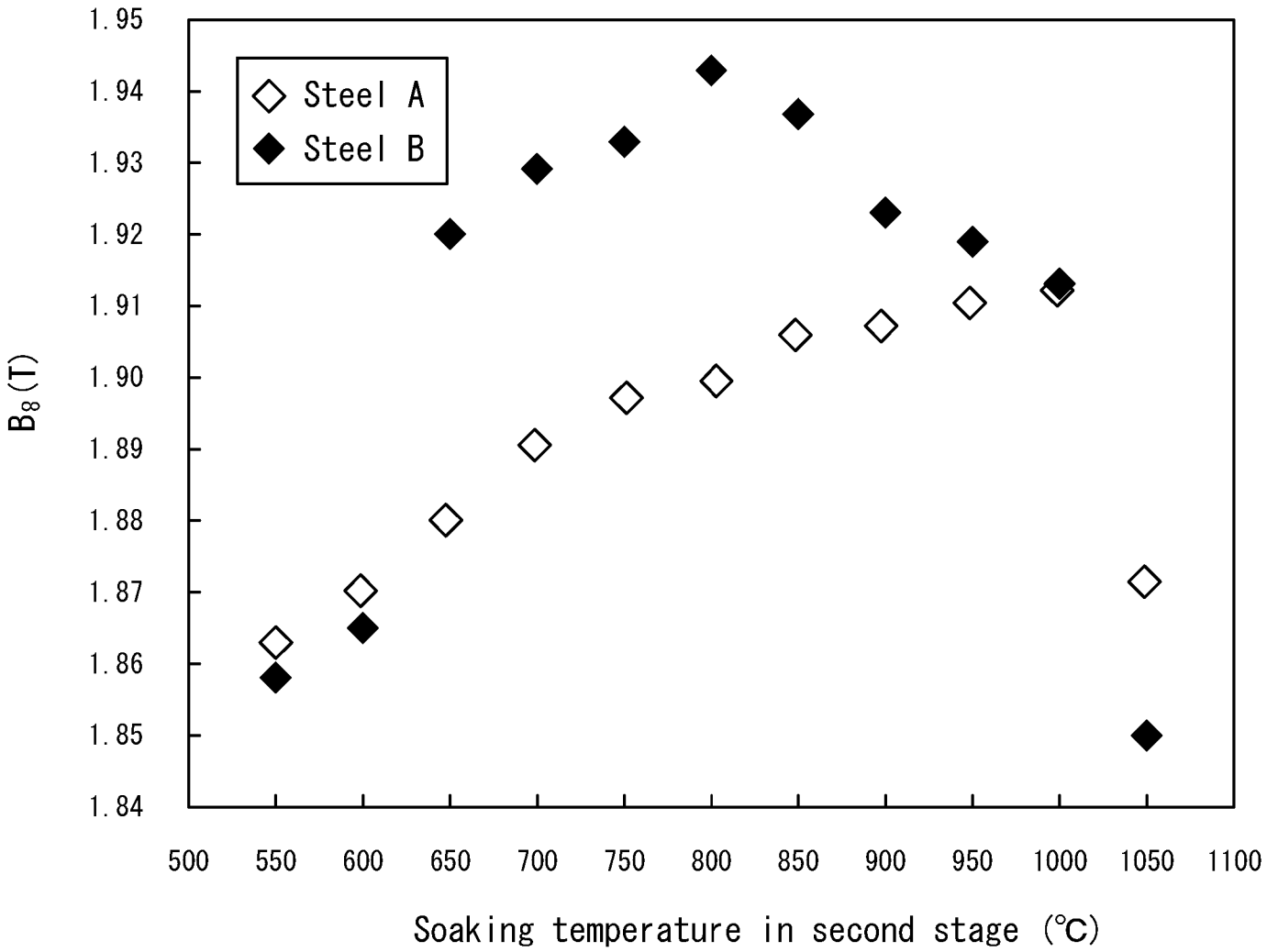
FIG. 2 is a graph illustrating the relationship between the soaking temperature in the second stage of annealing before final cold rolling and the magnetic flux density ($B_8$)
Figure 3:
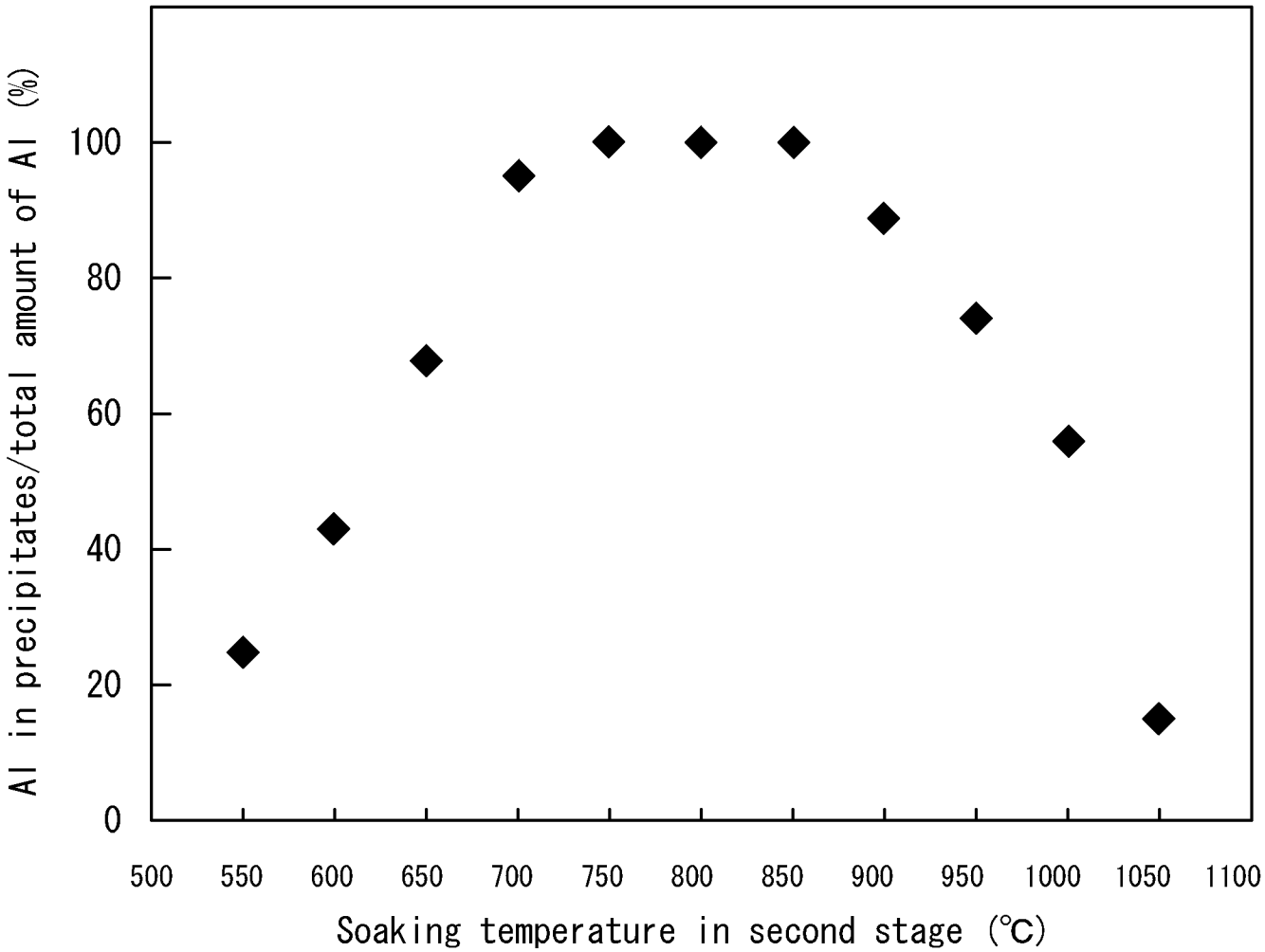
FIG. 3 is a graph illustrating the relationship between the soaking temperature in the second stage of annealing before final cold rolling and the proportion of the amount of Al in precipitates to the total amount of Al.
Figure 4:
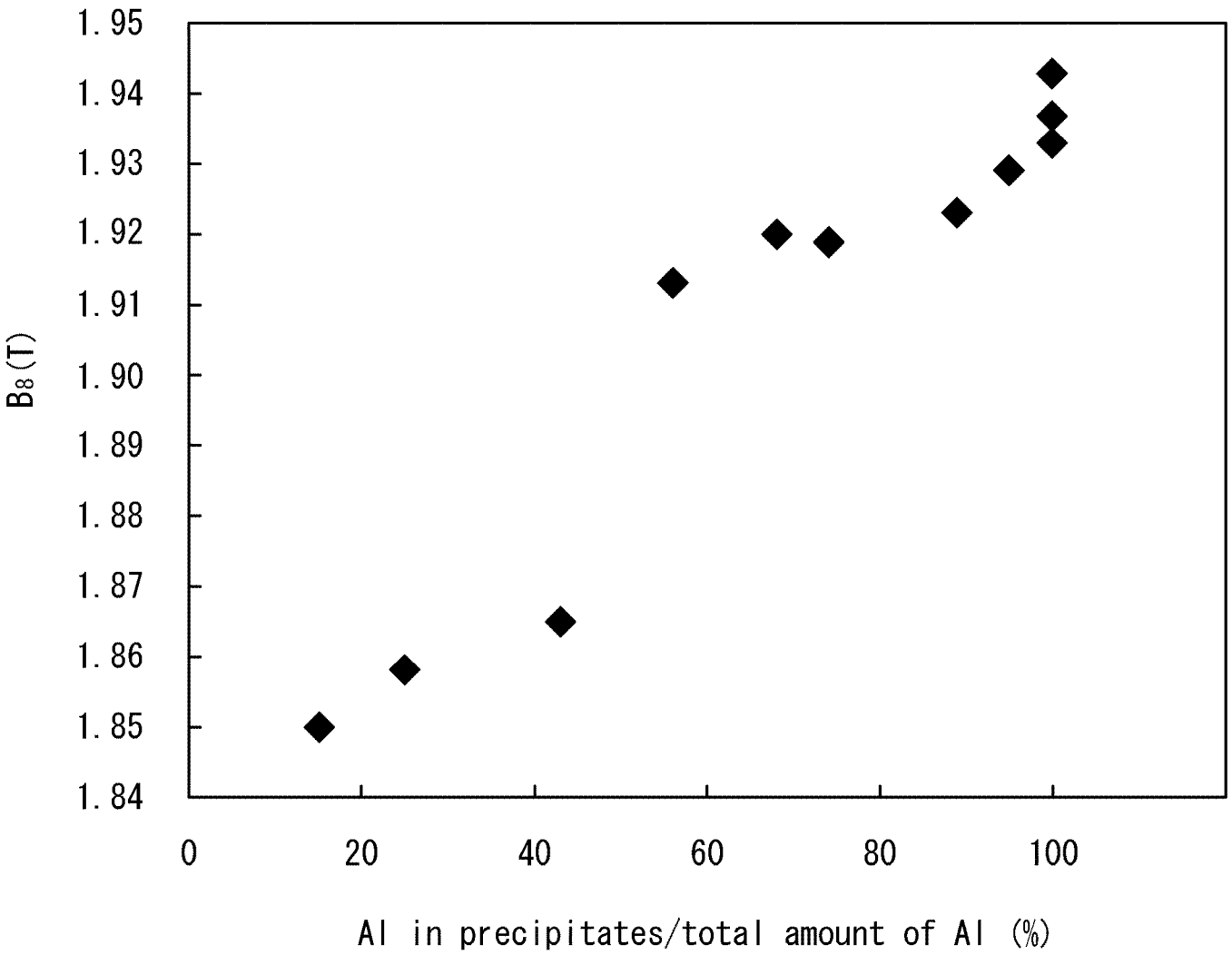
FIG. 4 is a graph illustrating the relationship between the proportion of the amount of Al in precipitates to the total amount of Al and the magnetic flux density.

A method of producing a grain-oriented electrical steel sheet according to one of the disclosed embodiments is described below. The reasons for limiting the chemical composition of steel are described first. In the description, "%" representing the content (amount) of each component element denotes "mass %" unless otherwise noted, and "ppm" denotes "mass ppm" unless otherwise noted.

C: 0.002% or More and 0.08% or Less

C is an element useful in improving primary recrystallized texture. If the C content is more than 0.08%, however, the primary recrystallized texture degrades. The C content is therefore limited to 0.08% or less in the present disclosure. The C content is desirably in a range of 0.002% or more and 0.06% or less, in terms of magnetic properties.

Si: 2.0% or More and 8.0% or Less

Si is an element useful in improving iron loss by increasing electrical resistance. If the Si content is more than 8.0%, however, secondary workability degrades significantly. The Si content is therefore limited to 8.0% or less. The Si content is in a range of 2.0% or more and 8.0% or less, in terms of iron loss.

Mn: 0.02% or More and 1.00% or Less

Mn has an effect of improving hot workability during production. If the Mn content is more than 1.00%, however, the primary recrystallized texture degrades, which leads to degradation in magnetic properties. The Mn content is therefore limited to 1.00% or less. The Mn content is in a range of 0.02% or more and 1.00% or less, in terms of magnetic properties.

N: Less than 60 ppm

Excessive N makes secondary recrystallization difficult. Particularly if the N content is 60 ppm or more, secondary recrystallization is unlikely to occur, and the magnetic properties degrade. The N content is therefore limited to less than 60 ppm.

Acid-Soluble Al (Sol.Al): Less than 100 ppm

Excessive Al also makes secondary recrystallization difficult. Particularly if the sol.Al content is 100 ppm or more, secondary recrystallization is unlikely to occur under the low-temperature slab heating conditions, and the magnetic properties degrade. Al is therefore limited to less than 100 ppm in sol.Al content.

S and/or Se: More than 0.0015% and 0.010% of Less in Total

In the present disclosure, it is most important that the total content of S and/or Se is more than 0.0015% and 0.010% or less. Se and S form precipitates such as an Mn compound or a Cu compound, and also inhibit grain growth as solute Se and solute S, to exhibit a magnetic property stabilizing effect.

If the total content of S and/or Se is 0.0015% or less, the amount of solute S and/or Se is insufficient, causing unstable magnetic properties. If the total content of S and/or Se is more than 0.010%, the dissolution of precipitates in slab heating before hot rolling is insufficient, causing unstable magnetic properties. The total content of S and/or Se is therefore in a range of more than 0.0015% and 0.010% or less.

The basic components according to the present disclosure have been described above. The balance other than the components described above is Fe and inevitable impurities. Additionally, the following elements may be optionally contained as appropriate as components for improving the magnetic properties industrially more stably.

Sn: 0.001% or More and 0.20% or Less

Sn has a function of suppressing the nitriding or oxidation of the steel sheet during secondary recrystallization annealing and promoting the secondary recrystallization of crystal grains having favorable crystal orientation to effectively improve the magnetic properties, in particular iron loss. To achieve this effect, the Sn content is preferably 0.001% or more. If the Sn content is more than 0.20%, cold rolling manufacturability degrades. Accordingly, the Sn content is desirably in a range of 0.001% or more and 0.20% or less.

Sb: 0.001% or More and 0.20% or Less

Sb is a useful element that suppresses the nitriding or oxidation of the steel sheet during secondary recrystallization annealing and promotes the secondary recrystallization of crystal grains having favorable crystal orientation to effectively improve the magnetic properties. To achieve this effect, the Sb content is preferably 0.001% or more. If the Sb content is more than 0.20%, cold rolling manufacturability decreases. Accordingly, the Sb content is desirably in a range of 0.001% or more and 0.20% or less.

Ni: 0.001% or More and 1.50% or Less

Ni has a function of improving the magnetic properties by enhancing the uniformity of the hot rolled sheet texture. To achieve this effect, the Ni content is preferably 0.001% or more. If the Ni content is more than 1.50%, secondary recrystallization is difficult, and the magnetic properties decrease. Accordingly, the Ni content is desirably in a range of 0.001% or more and 1.50% or less.

Cu: 0.001% or More and 1.50% or Less

Cu has a function of suppressing the oxidation of the steel sheet during secondary recrystallization annealing and promoting the secondary recrystallization of crystal grains having favorable crystal orientation to effectively improve the magnetic properties. To achieve this effect, the Cu content is preferably 0.001% or more. If the Cu content is more than 1.50%, hot rolling manufacturability decreases. Accordingly, the Cu content is desirably in a range of 0.001% or more and 1.50% or less.

Cr: 0.001% or More and 0.50% or Less

Cr has a function of stabilizing the formation of the forsterite base film. To achieve this effect, the Cr content is preferably 0.001% or more. If the Cr content is more than 0.50%, secondary recrystallization is difficult, and the magnetic properties degrade. Accordingly, the Cr content is desirably in a range of 0.001% or more and 0.50% or less.

P: 0.001% or More and 0.50% or Less

P is a useful element that improves primary recrystallized texture and promotes the secondary recrystallization of crystal grains having favorable crystal orientation to effectively improve the magnetic properties. To achieve this effect, the P content is preferably 0.001% or more. If the P content is more than 0.50%, cold rolling manufacturability decreases. Accordingly, the P content is desirably in a range of 0.001% or more and 0.50% or less.

Mo: 0.001% or More and 0.50% or Less

Mo has a function of suppressing high-temperature oxidation and reducing surface defects called scab. To achieve this effect, the Mo content is preferably 0.001% or more. If the Mo content is more than 0.50%, cold rolling manufacturability decreases. Accordingly, the Mo content is desirably in a range of 0.001% or more and 0.50% or less.

Ti: 0.001% or More and 0.10% or Less

Ti is a useful element that inhibits the growth of primary recrystallized grains and promotes the secondary recrystallization of crystal grains having favorable crystal orientation to improve the magnetic properties. To achieve this effect, the Ti content is desirably 0.001% or more. If the Ti content is more than 0.10%, Ti remains in the steel substrate and causes an increase in iron loss. Accordingly, the Ti content is desirably in a range of 0.001% or more and 0.10% or less.

Nb: 0.001% or More and 0.10% or Less

Nb is a useful element that inhibits the growth of primary recrystallized grains and promotes the secondary recrystallization of crystal grains having favorable crystal orientation to improve the magnetic properties. To achieve this effect, the Nb content is desirably 0.001% or more. If the Nb content is more than 0.10%, Nb remains in the steel substrate and causes an increase in iron loss. Accordingly, the Nb content is desirably in a range of 0.001% or more and 0.10% or less.

V: 0.001% or More and 0.10% or Less

V is a useful element that inhibits the growth of primary recrystallized grains and promotes the secondary recrystallization of crystal grains having favorable crystal orientation to improve the magnetic properties. To achieve this effect, the V content is desirably 0.001% or more. If the V content is more than 0.10%, V remains in the steel substrate and causes an increase in iron loss. Accordingly, the V content is desirably in a range of 0.001% or more and 0.10% or less.

B: 0.0002% or More and 0.0025% or Less

B is a useful element that inhibits the growth of primary recrystallized grains and promotes the secondary recrystallization of crystal grains having favorable crystal orientation to improve the magnetic properties. To achieve this effect, the B content is desirably 0.0002% or more. If the B content is more than 0.0025%, B remains in the steel substrate and causes an increase in iron loss. Accordingly, the B content is desirably in a range of 0.0002% or more and 0.0025% or less.

Bi: 0.001% or More and 0.10% or Less

Bi is a useful element that, by segregating to grain boundaries, inhibits the growth of primary recrystallized grains and promotes the secondary recrystallization of crystal grains having favorable crystal orientation to improve the magnetic properties. To achieve this effect, the Bi content is desirably 0.001% or more. If the Bi content is more than 0.10%, Bi remains in the steel substrate and causes an increase in iron loss. Accordingly, the Bi content is desirably in a range of 0.001% or more and 0.10% or less.

Te: 0.001% or More and 0.10% or Less

Te is a useful element that, by segregating to grain boundaries, inhibits the growth of primary recrystallized grains and promotes the secondary recrystallization of crystal grains having favorable crystal orientation to improve the magnetic properties. To achieve this effect, the Te content is desirably 0.001% or more. If the Te content is more than 0.10%, Te remains in the steel substrate and causes an increase in iron loss. Accordingly, the Te content is desirably in a range of 0.001% or more and 0.10% or less.

Ta: 0.001% or More and 0.10% or Less

Ta is a useful element that inhibits the growth of primary recrystallized grains and promotes the secondary recrystallization of crystal grains having favorable crystal orientation to improve the magnetic properties. To achieve this effect, the Ta content is desirably 0.001% or more. If the Ta content is more than 0.10%, Ta remains in the steel substrate and causes an increase in iron loss. Accordingly, the Ta content is desirably in a range of 0.001% or more and 0.10% or less.

The production conditions for a grain-oriented electrical steel sheet according to the present disclosure are described below.

[Heating]

A steel slab adjusted to the above-mentioned chemical composition is heated at 1300° C. or less. Limiting the heating temperature to 1300° C. or less is particularly effective in reducing scale which forms during hot rolling. Moreover, by limiting the heating temperature to 1300° C. or less, crystal texture can be refined and primary recrystallized texture with uniformly-sized grains can be realized.

[Hot Rolling]

After the heating, hot rolling is performed. The hot rolling is desirably performed with a start temperature of 1100° C. or more and a finish temperature of 800° C. or more, in terms of crystal texture refinement. The finish temperature is desirably 1000° C. or less, in terms of uniformizing crystal texture.

[Annealing Before Final Cold Rolling]

Following this, the hot rolled sheet is optionally hot band annealed. In the case of not performing intermediate annealing subsequently, the hot band annealing serves as the annealing before the final cold rolling.

The hot rolled sheet is then cold rolled once, or twice or more with intermediate annealing performed therebetween, to obtain a cold rolled sheet. In the case of not performing hot band annealing, intermediate annealing is definitely performed. This intermediate annealing serves as the annealing before the final cold rolling.

For high development of Goss texture in the product sheet, the annealing before the final cold rolling is performed in a two-stage heat pattern made up of soaking treatment in a first stage in a temperature range of 1000° C. or more and 1120° C. or less and soaking treatment in a second stage in a temperature range of 650° C. or more and 1000° C. or less, which is lower than that in the first stage. The temperature in the soaking treatment in each of the first stage and the second stage need not be constant, as long as the temperature stays in the corresponding temperature range for a predetermined time.

If the soaking temperature in the first stage is less than 1000° C., recrystallization is insufficient, and the magnetic properties degrade. If the soaking temperature in the first stage is more than 1120° C., the grain size before cold rolling coarsens excessively, and the magnetic properties degrade. Accordingly, the soaking temperature in the first stage is 1000° C. or more and 1120° C. or less. If the soaking time is more than 200 sec, the coarsening of sulfides progresses, and the inhibiting capability decreases, as a result of which the magnetic properties degrade. Accordingly, the soaking time in the first stage is 200 sec or less.

If the soaking temperature in the second stage is less than 650° C., the amount of precipitated Al after the annealing before the final cold rolling decreases, and the grain boundary segregation amount of solute S and/or Se decreases, as a result of which the magnetic properties decrease. If the soaking temperature in the second stage is more than 1000° C., the amount of precipitated Al after the annealing decreases, and secondary recrystallization is unstable, as a result of which the magnetic properties decrease. Accordingly, the soaking temperature in the second stage is 650° C. or more and 1000° C. or less. If soaking time in the second stage is more than 200 sec, the grain boundary precipitation of carbides progresses, and solute C decreases, as a result of which the magnetic properties decrease. Accordingly, the soaking time in the second stage is 200 sec or less.

In the cold rolling, it is effective to perform the rolling with the rolling temperature increased to 100° C. or more and 250° C. or less, or perform aging treatment once or more in a range of 100° C. or more and 250° C. or less during the cold rolling, in terms of developing Goss texture.

[Primary Recrystallization Annealing]

The obtained cold rolled sheet is subjected to primary recrystallization annealing. An objective of the primary recrystallization annealing is to cause the primary recrystallization of the cold rolled sheet having rolled microstructure to adjust it to an optimal primary recrystallized grain size for secondary recrystallization. For this objective, the annealing temperature in the primary recrystallization annealing is desirably about 800° C. or more and less than about 950° C. The annealing atmosphere may be a wet hydrogen nitrogen atmosphere or a wet hydrogen argon atmosphere so that the primary recrystallization annealing also serves as decarburization annealing.

In the primary recrystallization annealing, the average heating rate in a temperature range of 500° C. or more and 700° C. or less is preferably 50° C./s or more. Since this temperature range is the temperature range corresponding to the recovery of the texture after the cold rolling, by rapidly heating the cold rolled sheet at the above-mentioned average heating rate to suppress the recovery phenomenon and cause recrystallization, the amount of Goss-oriented crystal grains is enhanced and the crystal grain size after secondary recrystallization is reduced, with it being possible to improve the iron loss property.

[Nitriding Treatment]

During the primary recrystallization annealing, or before applying an annealing separator after the annealing, nitriding treatment may be further performed. The nitriding treatment can stabilize secondary recrystallization.

The method of nitriding treatment is not limited. For example, gas nitriding may be performed using $NH_3$ atmosphere or gas in coil form, or transported strips may be gas-nitrided continuously. Salt bath nitriding with higher nitriding ability than gas nitriding may also be used. As the salt bath in the case of using salt bath nitriding, a salt bath mainly composed of cyanate is suitable. The nitriding temperature and the nitriding time are preferably 500° C. or more and 1000° C. or less and about 20 sec to 600 sec in the case of gas nitriding, and 300° C. or more and 600° C. or less and about 20 sec to 600 sec in the case of salt bath nitriding.

[Application of Annealing Separator]

An annealing separator is applied to the surface of the steel sheet after the primary recrystallization annealing and before the secondary recrystallization annealing.

In the case where one or more selected from sulfide, sulfate, selenide, and selenite are added to the annealing separator, decomposition occurs at about 700° C. and the grain growth inhibiting capability is enhanced, with it being possible to improve the magnetic properties. While this effect is achieved even with a comparatively small amount, the effect is low if the additive amount is less than 1 part by mass relative to 100 parts by mass of MgO. If the additive amount is more than 30 parts by mass, oxidizability is excessively high, and the forsterite film is excessively thick, so that the bending peeling property of the formed forsterite film decreases. Accordingly, one or more selected from sulfide, sulfate, selenide, and selenite added to the annealing separator is preferably 1 part by mass or more and 30 parts by mass or less relative to 100 parts by mass of MgO.

[Secondary Recrystallization Annealing]

After this, secondary recrystallization annealing also serving as purification annealing is performed.

By setting the purification temperature in the secondary recrystallization annealing to more than 1180° C. and using a $H_2$ gas atmosphere as the gas atmosphere in the purification where, for example, $H_2$ is 10 vol % or more, components such as C, N, Al, S, and Se that are detrimental to the magnetic properties even in extremely small amounts can be purified thoroughly. The purification time is not limited, but is typically about 2 hr to 20 hr.

[Insulation Coating]

After the secondary recrystallization annealing, an insulating coating may be further applied to the surface of the steel sheet and baked, to form an insulation coating. The type of the insulating coating is not limited, and may be any conventionally well-known insulating coating. For example, a method of applying an application liquid containing phosphate-chromate-colloidal silica to the steel sheet and baking it at about 800° C. is preferable.

[Flattening Annealing]

After this, flattening annealing may be performed to arrange the shape of the steel sheet. This flattening annealing may also serve as the insulating coating baking treatment. The annealing temperature in the flattening annealing is preferably 800° C. to 900° C. The annealing time in the flattening annealing is preferably 10 sec or more and 120 sec or less.

The other production conditions may comply with typical grain-oriented electrical steel sheet production methods.

EXAMPLES

Example 1

Each steel slab having a composition containing C: 0.03%, Si: 3.4%, Mn: 0.10%, Cu: 0.06%, Sb: 0.06%, P: 0.06%, Mo: 0.06%, sol.Al: 60 ppm, N: 45 ppm, S: 50 ppm, Se: 1 ppm, and the balance being Fe and inevitable impurities was heated to 1250° C., and then hot rolled to obtain a hot rolled sheet with a sheet thickness of 2.4 mm. After this, the hot rolled sheet was subjected to hot band annealing under the conditions listed in Table 1. After the hot band annealing, the amount of Al in precipitates was measured.

TABLE 1

| | First stage | | Second stage | | Al | Magnetic flux | Iron | |
|---|---|---|---|---|---|---|---|---|
| No. | Soaking temperature (° C.) | Time (s) | Soaking temperature (° C.) | Time (s) | precipitation ratio (%) | density $B_8$ (T) | loss $W_{17/50}$ (W/kg) | Remarks |
| 1 | 1100 | 30 | 900 | 60 | 100 | 1.940 | 0.79 | Example |
| 2 | 1100 | 30 | 700 | 120 | 100 | 1.943 | 0.78 | Example |
| 3 | 1100 | 10 | 800 | 120 | 100 | 1.938 | 0.80 | Example |
| 4 | 1075 | 60 | 800 | 30 | 90 | 1.933 | 0.82 | Example |
| 5 | 1075 | 60 | 800 | 120 | 100 | 1.949 | 0.77 | Example |
| 6 | 1075 | 60 | 800 | 15 | 60 | 1.929 | 0.83 | Example |
| 7 | 1025 | 60 | 800 | 120 | 100 | 1.930 | 0.84 | Example |
| 8 | 1100 | 30 | None | — | 10 | 1.831 | 1.03 | Comparative Example |
| 9 | 900 | 30 | 800 | 60 | 80 | 1.885 | 1.00 | Comparative Example |
| 10 | 1150 | 30 | 800 | 60 | 80 | 1.842 | 1.02 | Comparative Example |
| 11 | 1100 | 300 | 900 | 60 | 100 | 1.901 | 0.93 | Comparative Example |
| 12 | 1075 | 30 | 1025 | 60 | 20 | 1.844 | 1.03 | Comparative Example |
| 13 | 1075 | 30 | 550 | 60 | 30 | 1.858 | 1.01 | Comparative Example |
| 14 | 1075 | 60 | 800 | 500 | 100 | 1.900 | 0.91 | Comparative Example |

Subsequently, the steel sheet was cold rolled at 200° C., to obtain a cold rolled sheet with a sheet thickness of 0.23 mm. The cold rolled sheet was then subjected to primary recrystallization annealing also serving as decarburization at 850° C. for 120 sec in an atmosphere of $H_2$: 55%, $N_2$: 45%, and dew point: 55° C., with the heating rate from 500° C. to 700° C. being 150° C./s.

After the primary recrystallization annealing, an annealing separator having MgO as a main ingredient was applied to the primary recrystallized sheet by 12.5 g/m$^2$ per both sides, and dried. Following this, the primary recrystallized sheet was subjected to secondary recrystallization annealing under the conditions of heating to 800° C. at a heating rate of 15° C./h, heating from 800° C. to 850° C. at a heating rate of 2.0° C./h, then retaining at 850° C. for 50 hr, then heating to 1160° C. at 5.0° C./h, and soaking for 5 hr. As the atmosphere gas, $N_2$ gas was used up to 850° C., and $H_2$ gas was used at 850° C. or more.

A treatment solution containing phosphate-chromate-colloidal silica at a mass ratio of 3:1:3 was applied to the surface of the secondary recrystallization annealed sheet obtained under the above-mentioned conditions, to perform flattening annealing. The magnetic flux density after the flattening annealing was measured.

As is clear from Table 1, by setting the total content of S and/or Se in the steel slab to more than 0.0015% and 0.010% or less and performing annealing before final cold rolling in a predetermined heat pattern, the amount of precipitated Al can be increased and the grain boundary segregation of solute S and/or Se can be facilitated to achieve favorable magnetic properties.

Example 2

Each steel slab having a composition containing the components listed in Table 2 and the balance being Fe and inevitable impurities was heated to 1250° C., and then hot rolled to obtain a hot rolled sheet with a sheet thickness of 2.6 mm. After this, the hot rolled sheet was subjected to hot band annealing in a two-stage heat pattern. Soaking in the first stage was performed at 1075° C. for 30 s, and soaking in the second stage was performed at 850° C. for 60 s.

After the hot band annealing, the amount of Al in precipitates was measured.

TABLE 2

| No. | C (%) | Si (%) | Mn (%) | N (%) | sol. Al (%) | S (%) | Se (%) | Al precipitation ratio (%) | Magnetic flux density $B_8$ (T) | Iron loss $W_{17/50}$ (W/kg) | Remarks |
|---|---|---|---|---|---|---|---|---|---|---|---|
| 1 | 0.03 | 3.3 | 0.12 | 0.004 | 0.005 | 0.0075 | 0.0001 | 100 | 1.940 | 0.88 | Example |
| 2 | 0.04 | 3.2 | 0.09 | 0.005 | 0.004 | 0.0093 | 0.0001 | 100 | 1.943 | 0.87 | Example |
| 3 | 0.02 | 3.2 | 0.08 | 0.003 | 0.003 | 0.0005 | 0.0050 | 100 | 1.948 | 0.84 | Example |
| 4 | 0.04 | 3.5 | 0.04 | 0.005 | 0.007 | 0.0005 | 0.0080 | 100 | 1.949 | 0.83 | Example |
| 5 | 0.03 | 3.4 | 0.14 | 0.004 | 0.006 | 0.0030 | 0.0030 | 100 | 1.945 | 0.84 | Example |
| 6 | 0.03 | 3.3 | 0.10 | 0.003 | 0.008 | 0.0070 | 0.0030 | 100 | 1.950 | 0.82 | Example |
| 7 | 0.02 | 3.4 | 0.12 | 0.003 | 0.004 | 0.0020 | 0.0001 | 100 | 1.933 | 0.90 | Example |
| 8 | 0.04 | 3.2 | 0.07 | 0.004 | 0.006 | 0.0010 | 0.0001 | 100 | 1.878 | 1.00 | Comparative Example |
| 9 | 0.03 | 3.3 | 0.10 | 0.004 | 0.006 | 0.0170 | 0.0001 | 100 | 1.853 | 1.05 | Comparative Example |
| 10 | 0.03 | 3.3 | 0.10 | 0.004 | 0.006 | 0.0005 | 0.0180 | 100 | 1.843 | 1.07 | Comparative Example |

Subsequently, the steel sheet was cold rolled at 180° C., to obtain a cold rolled sheet with a sheet thickness of 0.27 mm. The cold rolled sheet was then subjected to primary recrystallization annealing also serving as decarburization at 840° C. for 150 sec in an atmosphere of $H_2$: 55%, $N_2$: 45%, and dew point: 58° C., with the heating rate from 500° C. to 700° C. being 100° C./s.

After the primary recrystallization annealing, an annealing separator having MgO as a main ingredient was applied to the primary recrystallized sheet by 12.5 g/m$^2$ per both sides, and dried. Following this, the primary recrystallized sheet was subjected to secondary recrystallization annealing under the conditions of heating to 800° C. at a heating rate of 5° C./h, heating from 800° C. to 840° C. at a heating rate of 2.0° C./h, then retaining at 840° C. for 50 hr, then heating to 1160° C. at 5.0° C./h, and soaking for 5 hr. As the atmosphere gas, $N_2$ gas was used up to 840° C., and $H_2$ gas was used at 840° C. or more.

A treatment solution containing phosphate-chromate-colloidal silica at a mass ratio of 3:1:3 was applied to the surface of the secondary recrystallization annealed sheet obtained under the above-mentioned conditions, to perform flattening annealing. The results of measuring the magnetic flux density ($B_8$) and the iron loss ($W_{17/50}$) after the flattening annealing are listed in Table 2.

As is clear from Table 2, by setting the total content of S and/or Se in the steel slab to more than 0.0015% and 0.010% or less and performing annealing before final cold rolling in a predetermined heat pattern, the amount of precipitated Al can be increased and the grain boundary segregation of solute S and/or Se can be facilitated to achieve favorable magnetic properties.

Example 3

Each steel slab having a composition containing the components listed in Table 3 and the balance being Fe and inevitable impurities was heated to 1260° C., and then hot rolled to obtain a hot rolled sheet with a sheet thickness of 2.8 mm. After this, the hot rolled sheet was subjected to hot band annealing at 1025° C. for 30 sec. The hot rolled sheet was then cold rolled at 120° C., to obtain a cold rolled sheet of 1.8 mm. Subsequently, intermediate annealing was performed in a two-stage heat pattern. Soaking in the first stage was performed at 1050° C. for 30 s, and soaking in the second stage was performed at 800° C. for 90 s. After the intermediate annealing, the amount of Al in precipitates was measured.

TABLE 3

| No. | C (%) | Si (%) | Mn (%) | N (%) | sol. Al (%) | S (%) | Se (%) | Others (%) | Al precipitation ratio (%) | Magnetic flux density $B_8$ (T) | Iron loss $W_{17/50}$ (W/kg) | Remarks |
|---|---|---|---|---|---|---|---|---|---|---|---|---|
| 1 | 0.03 | 3.3 | 0.10 | 0.004 | 0.006 | 0.008 | 0.0001 | — — | 100 | 1.925 | 0.80 | Example |
| 2 | 0.03 | 3.3 | 0.10 | 0.004 | 0.006 | 0.001 | 0.0070 | Sn 0.08 | 100 | 1.932 | 0.75 | Example |
| 3 | 0.01 | 3.3 | 0.09 | 0.001 | 0.003 | 0.005 | 0.0001 | Sb 0.06 | 100 | 1.935 | 0.76 | Example |
| 4 | 0.03 | 3.2 | 0.12 | 0.003 | 0.004 | 0.007 | 0.0010 | Ni 0.45 | 100 | 1.938 | 0.77 | Example |
| 5 | 0.03 | 3.3 | 0.08 | 0.005 | 0.007 | 0.005 | 0.0020 | Cu 0.10 | 100 | 1.934 | 0.77 | Example |
| 6 | 0.05 | 3.5 | 0.15 | 0.005 | 0.009 | 0.008 | 0.0001 | Cr 0.10 | 100 | 1.932 | 0.76 | Example |
| 7 | 0.03 | 3.3 | 0.10 | 0.004 | 0.004 | 0.004 | 0.0010 | P 0.08 | 100 | 1.936 | 0.77 | Example |
| 8 | 0.02 | 3.2 | 0.07 | 0.003 | 0.005 | 0.003 | 0.0001 | Mo 0.10 | 100 | 1.938 | 0.76 | Example |
| 9 | 0.03 | 3.5 | 0.15 | 0.002 | 0.009 | 0.008 | 0.0001 | Ti 0.01 | 80 | 1.935 | 0.78 | Example |
| 10 | 0.04 | 3.4 | 0.14 | 0.004 | 0.004 | 0.005 | 0.0020 | Nb 0.005 | 90 | 1.940 | 0.75 | Example |
| 11 | 0.03 | 3.3 | 0.13 | 0.003 | 0.003 | 0.008 | 0.0001 | V 0.04 | 90 | 1.933 | 0.77 | Example |
| 12 | 0.02 | 3.2 | 0.10 | 0.005 | 0.006 | 0.006 | 0.0020 | B 0.001 | 90 | 1.935 | 0.78 | Example |
| 13 | 0.03 | 3.3 | 0.10 | 0.004 | 0.007 | 0.002 | 0.0020 | Bi 0.01 | 100 | 1.941 | 0.77 | Example |
| 14 | 0.03 | 3.3 | 0.08 | 0.004 | 0.007 | 0.008 | 0.0001 | Te 0.01 | 100 | 1.938 | 0.78 | Example |
| 15 | 0.03 | 3.3 | 0.08 | 0.004 | 0.007 | 0.004 | 0.0001 | Ta 0.02 | 100 | 1.939 | 0.76 | Example |

Subsequently, the steel sheet was cold rolled at 180° C., to obtain a cold rolled sheet with a sheet thickness of 0.20 mm. The cold rolled sheet was then subjected to primary recrystallization annealing also serving as decarburization at 840° C. for 100 sec in an atmosphere of $H_2$: 55%, $N_2$: 45%, and dew point: 53° C., with the heating rate from 500° C. to 700° C. being 50° C./s.

After the primary recrystallization annealing, an annealing separator obtained by adding $MgSO_4$ to MgO at a weight ratio of 10% was applied to the primary recrystallized sheet by 12.5 g/m$^2$ per both sides, and dried. Following this, the primary recrystallized sheet was subjected to secondary recrystallization annealing under the conditions of heating to 800° C. at a heating rate of 5° C./h, heating from 800° C. to 880° C. at a heating rate of 2.0° C./h, then retaining at 880° C. for 50 hr, then heating to 1160° C. at 5.0° C./h, and soaking for 5 hr. As the atmosphere gas, $N_2$ gas was used up to 840° C., and $H_2$ gas was used at 840° C. or more.

A treatment solution containing phosphate-chromate-colloidal silica at a mass ratio of 3:1:3 was applied to the surface of the secondary recrystallization annealed sheet obtained under the above-mentioned conditions, to perform flattening annealing. The results of measuring the magnetic flux density ($B_8$) and the iron loss ($W_{17/50}$) after the flattening annealing are listed in Table 3.

As is clear from Table 3, by setting the total content of S and/or Se in the steel slab to more than 0.0015% and 0.010% or less and performing annealing before final cold rolling in a predetermined heat pattern, the amount of precipitated Al can be increased and the grain boundary segregation of solute S and/or Se can be facilitated to achieve favorable magnetic properties.

Example 4

Each steel slab having a composition containing C: 0.02%, Si: 3.1%, Mn: 0.10%, Cu: 0.06%, Sb: 0.06%, P: 0.06%, Mo: 0.06%, Cr: 0.06%, sol.Al: 50 ppm, N: 45 ppm, S: 70 ppm, Se: 10 ppm, and the balance being Fe and inevitable impurities was heated to 1240° C., and then hot rolled to obtain a hot rolled sheet with a sheet thickness of 2.4 mm. After this, the hot rolled sheet was subjected to hot band annealing. The hot band annealing was performed in a two-stage heat pattern. Soaking in the first stage was performed at 1100° C. for 20 s, and soaking in the second stage was performed at 800° C. for 60 s. After the hot band annealing, the amount of Al in precipitates was measured.

Subsequently, the steel sheet was cold rolled at 180° C., to obtain a cold rolled sheet with a sheet thickness of 0.22 mm. The cold rolled sheet was then subjected to primary recrystallization annealing also serving as decarburization at 840° C. for 150 sec in an atmosphere of $H_2$: 55%, $N_2$: 45%, and dew point: 55° C., with the heating rate from 500° C. to 700° C. being 100° C./s. Following this, nitriding treatment was performed under the conditions listed in Table 4.

TABLE 4

| | Nitriding method | Temperature (° C.) | Time (s) | Amount of N after treatment (ppm) | Additive in MgO (%) | Al precipitation ratio (%) | Magnetic flux density $B_8$ (T) | Iron loss $W_{17/50}$ (W/kg) | Remarks |
|---|---|---|---|---|---|---|---|---|---|
| 1 | None | — | — | — | None | 100 | 1.940 | 0.79 | Example |
| 2 | $NH_3$ gas | 750 | 60 | 280 | None | 100 | 1.950 | 0.77 | Example |
| 3 | Salt bath | 550 | 140 | 350 | None | 100 | 1.954 | 0.76 | Example |
| 4 | None | — | — | — | $MgSO_4$ 5% | 100 | 1.948 | 0.76 | Example |
| 5 | None | — | — | — | MgS 5% | 100 | 1.950 | 0.75 | Example |
| 6 | None | — | — | — | MgSe 2% | 100 | 1.945 | 0.77 | Example |
| 7 | $NH_3$ gas | 750 | 30 | 230 | $MgSO_4$ 5% | 100 | 1.954 | 0.74 | Example |

After the primary recrystallization annealing, an annealing separator obtained by adding the agent listed in Table 4 to MgO as a main ingredient was applied to the primary recrystallized sheet by 12.5 g/m$^2$ per both sides, and dried. Following this, the primary recrystallized sheet was subjected to secondary recrystallization annealing under the conditions of heating to 800° C. at a heating rate of 5° C./h, heating from 800° C. to 880° C. at a heating rate of 2.0° C./h, then retaining at 880° C. for 50 hr, then heating to 1160° C. at 5.0° C./h, and soaking for 5 hr. As the atmosphere gas, $N_2$ gas was used up to 880° C., and $H_2$ gas was used at 880° C. or more.

As is clear from Table 4, the magnetic properties can be improved more stably by, in addition to setting the total content of S and/or Se in the steel slab to more than 0.0015% and 0.010% or less and performing annealing before final cold rolling in a predetermined heat pattern, performing nitriding treatment and/or adding one or more selected from sulfide, sulfate, selenide, and selenite to the annealing separator applied to the steel sheet before secondary recrystallization annealing.

The invention claimed is:

1. A method of producing a grain-oriented electrical steel sheet, comprising:

heating a steel slab at 1300° C. or less, the steel slab having a chemical composition containing, in mass %,
C: 0.002% or more and 0.08% or less,
Si: 2.0% or more and 8.0% or less,
Mn: 0.02% or more and 1.00% or less,
S and/or Se: more than 0.0015% and 0.010% or less in total,
N: less than 60 mass ppm,
acid-soluble Al: 0.003% or more and less than 100 mass ppm, and
a balance being Fe and inevitable impurities;

subjecting the steel slab to hot rolling, to obtain a hot rolled steel sheet;

optionally subjecting the hot rolled steel sheet to hot band annealing;

subjecting the hot rolled steel sheet to cold rolling twice or more with intermediate annealing performed therebetween, to obtain a cold rolled steel sheet;

subjecting the cold rolled steel sheet to primary recrystallization annealing;

applying an annealing separator to a surface of the cold rolled steel sheet after the primary recrystallization annealing; and then subjecting the cold rolled steel sheet to secondary recrystallization annealing, wherein in the intermediate annealing step immediately before a final cold rolling, the steel sheet is soaked at a first soaking temperature in a range of 1000° C. or more and 1120° C. or less for 10 sec or more and 200 sec or less and then soaked at a second soaking temperature in a range of 650° C. or more and 1000° C. or less for 15 sec or more and 200 sec or less, the second soaking temperature being lower than the first soaking temperature, and an amount of Al in precipitates after the intermediate annealing step immediately before the final cold rolling is limited to 50% or more of a total amount of Al contained in the steel slab.

2. The method of producing a grain-oriented electrical steel sheet according to claim 1, comprising subjecting the cold rolled steel sheet to nitriding treatment.

3. The method of producing a grain-oriented electrical steel sheet according to claim 1, wherein one or more selected from sulfide, sulfate, selenide, and selenate are added to the annealing separator.

4. The method of producing a grain-oriented electrical steel sheet according to claim 1, wherein the chemical composition further contains, in mass %, one or more selected from Sn: 0.001% or more and 0.20% or less, Sb: 0.001% or more and 0.20% or less, Ni: 0.001% or more and 1.50% or less, Cu: 0.001% or more and 1.50% or less, Cr: 0.001% or more and 0.50% or less, P: 0.001% or more and 0.50% or less, Mo: 0.001% or more and 0.50% or less, Ti: 0.001% or more and 0.10% or less, Nb: 0.001% or more and 0.10% or less, V: 0.001% or more and 0.10% or less, B: 0.0002% or more and 0.0025% or less, Bi: 0.001% or more and 0.10% or less, Te: 0.001% or more and 0.10% or less, and Ta: 0.001% or more and 0.10% or less.

5. The method of producing a grain-oriented electrical steel sheet according to claim 4, comprising subjecting the cold rolled steel sheet to nitriding treatment.

6. The method of producing a grain-oriented electrical steel sheet according to claim 4, wherein one or more selected from sulfide, sulfate, selenide, and selenate are added to the annealing separator.

7. A method of producing a grain-oriented electrical steel sheet, comprising:

heating a steel slab at 1300° C. or less, the steel slab having a chemical composition containing, in mass %, C: 0.002% or more and 0.08% or less, Si: 2.0% or more and 8.0% or less, Mn: 0.02% or more and 1.00% or less, S and/or Se: more than 0.0015% and 0.010% or less in total, N: less than 60 mass ppm, acid-soluble Al: 0.003% or more and less than 100 mass ppm, and a balance being Fe and inevitable impurities;

subjecting the steel slab to hot rolling, to obtain a hot rolled steel sheet;

subjecting the hot rolled steel sheet to hot band annealing;

subjecting the hot rolled steel sheet to cold rolling once only to obtain a cold rolled steel sheet;

subjecting the cold rolled steel sheet to primary recrystallization annealing;

applying an annealing separator to a surface of the cold rolled steel sheet after the primary recrystallization annealing; and then subjecting the cold rolled steel sheet to secondary recrystallization annealing, wherein in the hot band annealing step, the hot rolled steel sheet is soaked at a first soaking temperature in a range of 1000° C. or more and 1120° C. or less for 10 sec or more and 200 sec or less and then soaked at a second soaking temperature in a range of 650° C. or more and 1000° C. or less for 15 sec or more and 200 sec or less, the second soaking temperature being lower than the first soaking temperature, and an amount of Al in precipitates after the hot band annealing is limited to 50% or more of a total amount of Al contained in the steel slab.

* * * * *